US011571744B2

(12) United States Patent
Chen et al.

(10) Patent No.: US 11,571,744 B2
(45) Date of Patent: Feb. 7, 2023

(54) MICRO POWDER FOR PREPARING NEODYMIUM-IRON-BORON PERMANENT MAGNET MATERIAL, METHOD FOR PREPARING POWDER BY TARGET-TYPE JET MILLING, AND POWDER

(71) Applicants: SANVAC (BEIJING) MAGNETICS CO., LTD., Beijing (CN); BEIJING ZHONG KE SAN HUAN HI-TECH CO., LTD., Beijing (CN)

(72) Inventors: Guoan Chen, Beijing (CN); Bin Fang, Beijing (CN); Libai Sun, Beijing (CN); Yugang Zhao, Beijing (CN)

(73) Assignees: SANVAC (BEIJING) MAGNETICS CO., LTD., Beijing (CN); BEIJING ZHONG KE SAN HUAN HI-TECH CO., LTD., Beijing (CN)

( * ) Notice: Subject to any disclaimer, the term of this patent is extended or adjusted under 35 U.S.C. 154(b) by 892 days.

(21) Appl. No.: 16/448,979

(22) Filed: Jun. 21, 2019

(65) Prior Publication Data

US 2020/0030884 A1 Jan. 30, 2020

Related U.S. Application Data

(63) Continuation of application No. PCT/CN2017/115679, filed on Dec. 12, 2017.

(30) Foreign Application Priority Data

Dec. 21, 2016 (CN) ..... 201611189003.X

(51) Int. Cl.
*B22F 9/04* (2006.01)
*H01F 1/057* (2006.01)
(Continued)

(52) U.S. Cl.
CPC ..... *B22F 9/04* (2013.01); *B02C 19/06* (2013.01); *B02C 23/10* (2013.01); *B22F 1/065* (2022.01);
(Continued)

(58) Field of Classification Search
None
See application file for complete search history.

(56) References Cited

U.S. PATENT DOCUMENTS 4,783,215 A 11/1988 Kemp, Jr. et al.
5,133,504 A * 7/1992 Smith ..... B02C 19/068 241/5
2013/0248628 A1 9/2013 Kakuda et al.

FOREIGN PATENT DOCUMENTS

CN 1049983 A 3/1991
CN 1032957 C * 10/1996
(Continued)

OTHER PUBLICATIONS

Machine translation of CN 1032957C. (Year: 1996).*
(Continued)

*Primary Examiner* — Xiaowei Su
(74) *Attorney, Agent, or Firm* — Anova Law Group, PLLC

(57) ABSTRACT

The current invention discloses a type of micronized powder for manufacturing sintered Neodymium magnetic material, a target type jet mill pulverization method to prepare the micronized powder, and the resulting pulverized powder. The Neodymium magnet powder created under the method is of sphericity of greater than or equal to 90% and of particle adhesion rate of less than or equal to 10%. A is the diameter of the target center, B is the diameter of the side nozzle, and C is the distance between the target center and the nozzle. The relationship amongst A, B and C is A/B=m×
(Continued)

(C/A+B), where m ranges from 1 to 7. A velocity of the jet stream from side nozzle is between about 320 m/s to about 580 m/s.

12 Claims, 4 Drawing Sheets

(51) Int. Cl.

| | |
|---|---|
| ***B22F 1/00*** | (2022.01) |
| ***B02C 19/06*** | (2006.01) |
| ***B02C 23/10*** | (2006.01) |
| ***B22F 1/065*** | (2022.01) |

(52) U.S. Cl.
CPC ..... *H01F 1/0571* (2013.01); *B22F 2009/044* (2013.01); *B22F 2301/355* (2013.01); *B22F 2304/10* (2013.01)

(56) References Cited

FOREIGN PATENT DOCUMENTS

| | | | |
|---|---|---|---|
| CN | 101767200 | A | 7/2010 |
| CN | 103219117 | A | 7/2013 |
| CN | 103785845 | A | 5/2014 |
| CN | 103990805 | A | 8/2014 |
| CN | 104174857 | A | 12/2014 |
| CN | 104289713 | A | 1/2015 |
| CN | 104439258 | A | 3/2015 |
| CN | 105964376 | A | 9/2016 |
| JP | 6283401 | A | 4/1987 |
| JP | H09143514 | A | 6/1997 |
| JP | 2005179749 | A | 7/2005 |
| JP | 2008214661 | A | 9/2008 |
| WO | 2015146888 | A1 | 10/2015 |

OTHER PUBLICATIONS

Machine translation of CN 104174857A (Year: 2014).*

The China National Intelleectual Property Administration (CNIPA) the China Search Report and First Office Action for 201611189003.X dated Mar. 26, 2021 14 Pages (including translation).

The Japan Patent Office (JPO) Notice of Reasons for Refusal for JP Application No. 2019-534702 dated Mar. 5, 2021 9 pages (including translation).

Hongjiu Pu:"Diversified Management Strategy of Coal Industry", Coal Industry Press,CN, p. 179 Nov. 30, 2000 5 pages (including translation).

International Search Report issued in corresponding International Application No. PCT/CN2017/115679, dated Feb. 14, 2018, 7 pages.

Written Opinion of the International Searching Authority issued in corresponding International Application No. PCT/CN2017/115679, dated Feb. 14, 2018, 6 pages.

* cited by examiner

MICRO POWDER FOR PREPARING NEODYMIUM-IRON-BORON PERMANENT MAGNET MATERIAL, METHOD FOR PREPARING POWDER BY TARGET-TYPE JET MILLING, AND POWDER

CROSS-REFERENCE TO RELATED APPLICATIONS

This application is continuation of International Application No. PCT/CN2017/115679, filed on Dec. 12, 2017, entitled "MICRO POWDER FOR PREPARING NEODYMIUM-IRON-BORON PERMANENT MAGNET MATERIAL, METHOD FOR PREPARING POWDER BY TARGET-TYPE JET MILLING, AND POWDER," which claims priority to Chinese Patent Application No. 201611189003.X, filed on Dec. 21, 2016, entitled "MICRO POWDER FOR PREPARING NEODYMIUM-IRON-BORON PERMANENT MAGNET MATERIAL, METHOD FOR PREPARING POWDER BY TARGET-TYPE JET MILLING, AND POWDER." Each of the above-identified application is hereby incorporated by reference in its entirety.

TECHNICAL FIELD

The current invention involved a type of micronized powder for manufacturing sintered Neodymium magnetic material, a target type jet mill pulverization method to prepare the micronized powder and the resulting pulverized powder.

BACKGROUND

Sintered Neodymium multiphasic material in the main $R_2T_{14}B$ phase has properties including superior magnetic performance, relatively inexpensive production cost and low processing difficulty resulting its widespread applications in national pillar industries including energy, communication, transportation, national defense and medical with huge market demands. Currently, Sintered Neodymium materials are commonly prepared by powder metallurgy, wherein the final magnetic properties largely depend on quality of the powder before compression. Particle-size distribution of the powder is critical in determining magnetization as well as coercivity of magnets in final production. Hydrogen decrepitation (HD) and jet mill ultrafine pulverization are commonly adopted as secondary crushing methods in modern industrial production for manufacturing micronized powder. Uniform particle-size distribution and controllable particle-size result these two methods preferable in high-quality Sintered Neodymium magnetic powder manufacturing. As the last process of micronized powder production, jet mill pulverization is a key element in the entire manufacturing process. In order to obtain satisfying magnetic orientation, the desired magnetic powder should meet the following conditions: ① magnetic powder are of small particles-size (about 3 μm to about 4 μm) with low dispersion; particles of about 3 μm to about 4 μm in particle-size take up about 95% of the entity with no presence of particles of less than 1 μm or greater than 7 μm in particle size; all particles should be single crystals. ② magnetic particles are spherical or substantially spherical. ③ minimum crystallographic defects in magnetic powder particles. ④ particles are broken preferably along the grain boundary to prepare as many surfaces in Nd-rich phase as possible for all particles, which effectively prevent the occurrence of different grain boundaries in liquid phase sintering. ⑤ minimum impurities and gas absorption on magnetic powder particle surfaces, especially oxygen. The previous five conditions listed above are essential for manufacturing high-quality sintered Neodymium magnetic materials.

Nitrogen gas is now commonly adopted in jet mill pulverization, which effectively prevents the particles from oxidization. However, coarse powder produced by HD, even after dehydrogenation treatment, contains hydrogen, which reacts easily with nitrogen gas under certain circumstances, increasing the content of nitrogen in the magnet and reducing the performances of produced magnetic material as results. Meanwhile, the low molecular mass and low kinetic energy transfer efficiency of nitrogen gas decrease the efficiency of collision between coarse powder particles.

Literature data show, there are patents regarding sintered magnetic material have mentioned improvements gas source in jet mill pulverization. The prior art discloses a method for preparing a Re—Fe—B type permanent magnet material containing small amount of nitrogen, wherein argon or nitrogen of no more than 10 deg. are recommended as protection gas in the pulverizing process to reduce nitrogen content in magnetic material. However, no information regarding the influence of argon gas source on powder preparation and on produced powder after pulverization. According to a patent regarding manufacturing permanent Neodymium material, the mixture of nitrogen and argon could be used as the source gas for jet mill. The patent pointed out that the usage of such mixture increases the success rate of one-time collision between Neodymium particles, but no implementation methods and efficiency reports were disclosed regarding such method. Moreover, there are patents disclose the usage of gas with smaller molecule mass than nitrogen such as hydrogen and helium and gas with larger molecule mass than nitrogen such as argon as the source gas for jet mill. However, hydrogen is explosive when combined with oxygen and helium reduces the particle-size during pulverization producing more ultrafine powder at slow rate with expensive cost. Therefore, in summary, adopting nitrogen as the source gas for jet mill pulverization is practical in applications. The focus of our work aims to overcome the side effects such innovation brings.

SUMMARY

Given the problems of prior art, the present disclosure provides a type of micronized powder for manufacturing sintered Neodymium magnetic material, a target type jet mill pulverization method to prepare the micronized powder and the resulting pulverized powder. The present disclosure is designed to improve conventional fluidized bed mill pulverization method by adopting a target type jet mill in pulverization with optimized parameter setting. The improved method does not only better protect the powder particles and refine powder particle-size but also improve the sphericity of pulverized powder particles and prevent particle defects. The micronized powder prepared under the method in present disclosure is ideal for manufacturing sintered Neodymium magnetic material with preferable coercivity, squareness and magnetic performances by subsequent procedures.

The present disclosure also discloses a target type jet mill pulverization method to prepare micronized powder, which is characterized by: A is the diameter of the target, B is the diameter of the side nozzle, and C is the distance between the target and the nozzle. The relationship between A, B and C is: A/B=m×(C/(A+B)), where m ranges from 1 to 7, preferably from 2 to 5; velocity of the jet stream from side nozzle is about 320 m/s to about 580 m/s, preferably about 400 m/s to about 520 m/s.

Relationship between the diameter of the classifier wheel F and the diameter of target A is: F=p×A, wherein p ranges from 3 to 6, preferably from 3.5 to 4.5.

A preferred embodiment of the present disclosure is of which target, side nozzle and classifying wheel are made of silicon nitride.

Preferably, collecting the micronized powder includes flowing pulverized powder having the micronized powder and the ultrafine powder into a cyclone separator, filtering out the ultrafine powder that has diameters less than about 1 μm at an exit of the cyclone separator, and collecting the micronized powder at another exit after the ultrafine powder are filtered out. The cyclone separator includes a baffle having a flange which comprises a plurality of holes with diameters of less than or equal to about 1 μm.

Furthermore, nitrogen is the pulverizing gas in the target type jet mill pulverizing method described above, wherein pulverizing pressure is about 0.3 MPa to about 0.8 MPa, preferably about 0.4 MPa to about 0.7 MPa.

Preferably, target type jet mill pulverization does produce little or no material residual (e.g., bed weight material). The material residual refers to the ultrafine powder not filtered out, e.g., remained, in the pulverized powder.

The present disclosure also discloses one type of pulverized powder produced by the method described above, wherein the powder consists of ultrafine powder and the claimed micronized powder. The ultrafine powder is of less than 0.5% of the pulverized powder in percentage by weight.

The present disclosure discloses a type of micronized powder for manufacturing sintered Neodymium magnetic material produced by the method described above. The micronized powder has sphericity ≥90% (e.g., greater than or equal to 90%) and particle adhesion rate 10% (e.g., less than or equal to 10%). Preferably, the micronized powder has sphericity 94%.

Furthermore, the micronized powder particle size D50 is about 2 μm to about 5 while a ratio of D90 over D10 is about 2 to about 5 (e.g., D90/D10=2~5). Nitrogen concentration of the micronized powder is equal or less than 300 parts per million (i.e., ppm).

The present disclosure prepares micronized powder for sintered Neodymium magnetic material by target type jet mill pulverizing. Micronized powder with superior quality was obtain by optimizing parameters in target type jet mill pulverization such as pulverizing pressure and velocity of jet stream from nozzle. The present disclosure minimizes the number of collisions between Neodymium particles in pulverization by controlling grain boundaries in the process. The improvement does not only decrease dispersion of particle size distribution of the micronized powder but also reduce the density of ultrafine powder produced through excessive collisions, resulting in more production of desired micronized powder and less loss of rare earth elements.

The present disclosure only produces ultrafine powder and the micronized powder in pulverization, wherein ultrafine powder is of minimum amount. The micronized powder is characterized by evenly distributed particle size, high uniformity and low dispersion. Furthermore, the pulverization does not produce material residual, leading to greater yield rate of the desired powder.

The target type jet mill pulverization method of the present disclosure delivers large yield rate, wherein the powder produced exhibits low nitrogen concentration and low particle adhesion rate, which are ideal for mass production of high-quality sintered Neodymium magnetic material.

DETAILED DESCRIPTION

Figure 1:
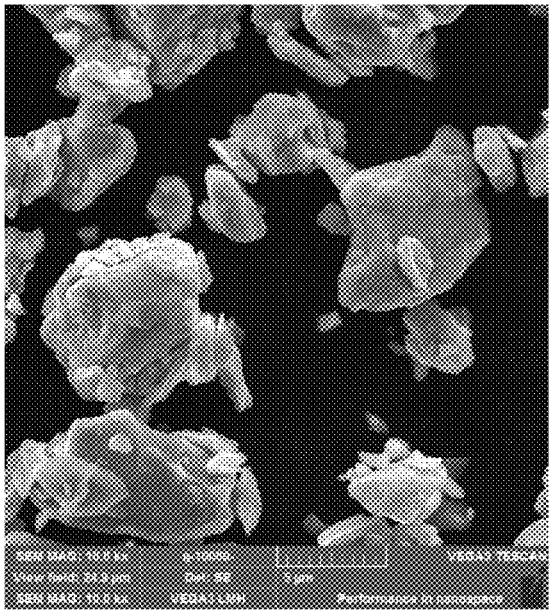
FIG. 1 is microstructural imaging photograph of the micronized powder samples from example 1 (magnification ×10000).

As used herein, the term "about" indicates the value of a given quantity that can vary based on a particular technology node associated with the subject semiconductor device. Based on the particular technology node, the term "about" can indicate a value of a given quantity that varies within, for example, 10-30% of the value (e.g., ±10%, ±20%, or ±30% of the value).

Target type jet mill pulverization method adopts nitrogen gas as pulverizing gas and silicon nitride de Laval nozzle as the side nozzle, which in the only nozzle in the system. The commonly used fluidized bed jet mill pulverization requires two nozzles with one on the side and the other at the bottom. In the present disclosure, the target is made of silicon nitride.

A is the diameter of the target, B is the diameter of the side nozzle, and C is the distance between the target and the nozzle. The relationship amongst A, B and C is: A/B=m×(C/(A+B)), where m ranges from 1 to 7, preferably from 2 to 5. The dispersion of particle size distribution can be effectively decreased by limiting the value of m.

In the present disclosure, stream velocity from side nozzle can be accordingly adjusted in the range of about 320 m/s to about 580 m/s, preferably in the range of about 400 m/s to about 520 m/s. In the present disclosure, nitrogen gas is adopted as pulverizing gas. The pulverization process is effective with particle size uniformly distributed. Relationship between the diameter of the classifier wheel F, which could be made from silicon nitride, and the diameter of target A is: F=p×A, wherein p ranges from 3 to 6, preferably from 3.5 to 4.5.

In the present disclosure, the pulverizing pressure is in the range of about 0.3 MPa to about 0.8 MPa, preferably in the range of about 0.3 MPa to about 0.7 MPa for better particle size distribution.

In the present disclosure, the pulverized powder consists only ultrafine powder and the desired micronized powder after target type jet mill pulverization with little or no material residual, wherein the ultrafine powder takes no more than 0.5% of total powder production in weight. Given the fact that the present disclosure only produces ultrafine powder and the desired micronized powder after pulverization, thus the ultrafine powder takes no more than 0.5% of total powder input in weight.

In traditional fluidized jet mill pulverization, residual materials will be produced in the grinding chamber resulting not only low efficiency in pulverization but also deviations in particle size, density and composition in the pulverized powder. Further material input is required to mix with such residual materials to continue pulverizing. The present disclosure, however, produces no residual materials in the target type jet mill pulverization method with particle size of the powder uniformly distributed along the entire process.

In the present disclosure, the method produces ideal Neodymium magnetic material powder by controlling the value as m and p as well as velocity of the jet stream from the side nozzle.

In the present disclosure, the micronized powder produced is characterized by nitrogen content ≤300 ppm, sphericity >90% and particle adhesion rate ≤10%. The micronized powder particle size $D_{50}$ is about 2 μm to about 5 μm while $D_{90}/D_{10}$ is equal to about 2 to about 5 with low dispersion in particle size distribution. In the present disclosure, $D_X$ represents the diameter of the particle which divides the mass of the micronized powder into a specified percentage when the particles are arranged on an ascending mass basis, e.g., in a particle size distribution curve. For example, $D_{10}$ is the diameter at which 10% of the mass of the micronized powder is comprised of particles with a diameter less than $D_{10}$, and $D_{90}$ is the diameter at which 90% of the mass of the micronized powder is comprised of particles with a diameter less than $D_{90}$. $D_{50}$, also referred to as the median diameter, represents the diameter of the particle that 50% of the mass of the micronized powder is smaller than and 50% of a sample's mass is larger than.

In the present disclosure, the pulverized powder, formed from a mixture of coarse alloy powder (e.g., Neodymium powder) and lubricator undergoing a target type jet mill pulverization process, includes the micronized powder. The micronized powder may be flown into a cyclone separator to filtering out particles with diameters greater than 1 μm. The micronized powder may be steered by a carrier gas (e.g., nitrogen) and flown towards an exit (e.g., an upper exit) of the cyclone separator. The micronized powder and the carrier gas may be separated due to the gravity and centrifugal force. The micronized powder may then be flown through a flange of a baffle at the exit of the cyclone separator. The flange may have a circular shape and may include a plurality of holes with diameters of less than or equal to about 1 μm. The flange may filter out particles having diameters less than 1 μm. The micronized powder, after particles with diameters of less than about 1 μm are filtered out, may be collected using a collecting device. That is, the flange may prevent particles with diameters less than 1 μm to be collected in the collecting device at another exit (e.g., a lower exit).

Figure 2:
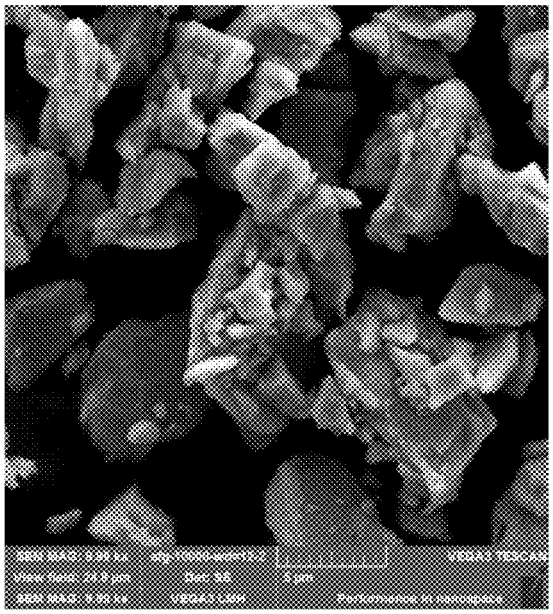
FIG. 2 is microstructural imaging photograph of the micronized powder samples from comparative example 1 (magnification ×10000).
Figure 3:
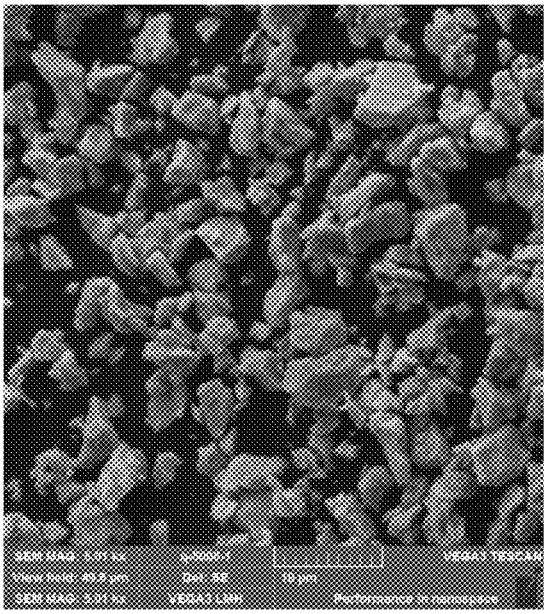
FIG. 3 is microstructural imaging photograph of the micronized powder samples from example 1 (magnification ×5000).
Figure 4:
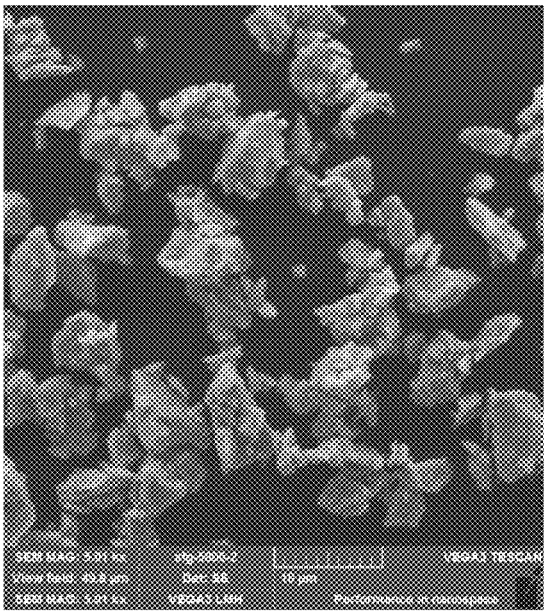
FIG. 4 is microstructural imaging photograph of the micronized powder samples from comparative example 1 (magnification ×5000).
Figure 5:
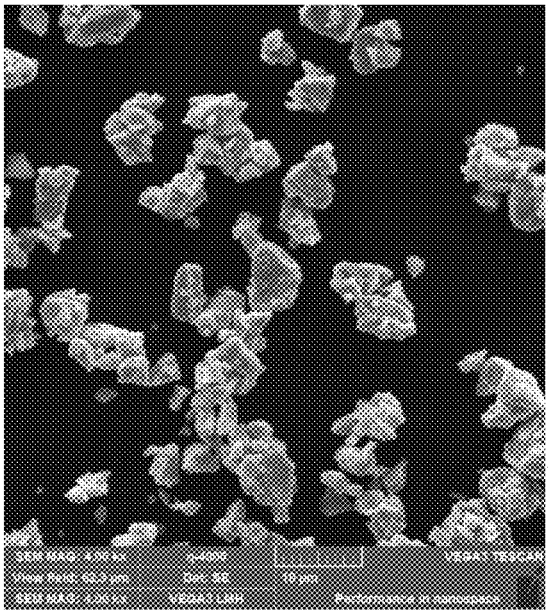
FIG. 5 is microstructural imaging photograph of the micronized powder samples from example 1 (magnification ×4000).
Figure 6:
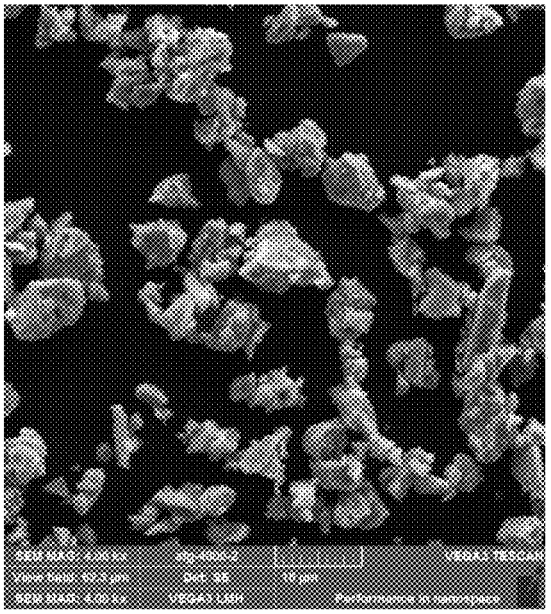
FIG. 6 is microstructural imaging photograph of the micronized powder samples from comparative example 1 (magnification ×4000).
Figure 7:
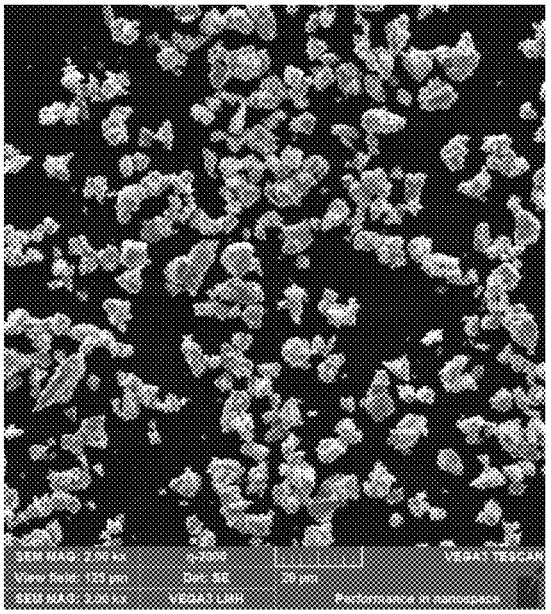
FIG. 7 is microstructural imaging photograph of the micronized powder samples from example 1 (magnification ×2000).
Figure 8:
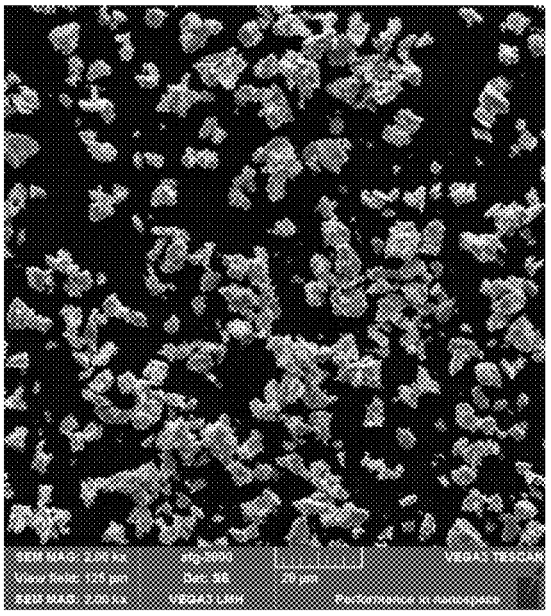
FIG. 8 is microstructural imaging photograph of the micronized powder samples from comparative example 1 (magnification ×2000).

In the present disclosure, a particle in the micronized powder with an aspect ratio (e.g., a ratio of a length along the vertical direction over a width along the horizontal direction of a two-dimensional object) of about 1:1 observed in the microstructural imaging photographs (e.g., FIGS. 1-8) is regarded as a spherical particle. In some embodiments, the aspect ratio is determined to be in a desired range to determine the sphericity of the micronized powder. For example, it can be determined that a particle with an aspect ratio within a range of ±10% of 1:1 (e.g., 0.9:1, 0.95:1, 0.98:1, 1:1, 1:1.02, 1:1.05, and 1:1.1) can be consider a spherical particle. In another example, it can be determined that a particle with an aspect ratio within a range of ±15% of 1:1 (e.g., 0.85:1, 0.9:1, 0.95:1, 0.98:1, 1:1, 1:1.02, 1:1.05, 1:1.1, and 1:1.15) can be consider a spherical particle. The specific values of the upper and lower limits of the range should not be limited by the embodiments of the present disclosure.

In the present disclosure, a sphericity of the micronized powder can be defined to be a total number of spherical particles divided by a total number of particles observed in the micronized powder. In some embodiments, a sample having a number of particles, e.g., 500 particles, can be selected. The number of spherical particles in the sample can be determined. The sphericity of the sample can then be calculated as the number of spherical particles divided by 500. In some embodiments, the sphericity of the sample can be used to represent the sphericity of a portion or all the particles of the micronized powder.

In the present disclosure, a particle, observed in the microstructural imaging photographs, adhering to other particles having diameters of less than about 1 μm is regarded as having little or no adhesion. In some embodiments, it is determined the diameters are within a desired range, e.g., ±10% or ±15% of 1 μm (e.g., 0.95 μm, 0.98 μm, 1 μm, 1.05 μm, 1.08 μm, and 1.1 μm), and particles observed with adhesion to other particles having diameters in the range are determined to have little or no adhesion. Accordingly, a particle observed with adhering to other particles having diameters of about 1 μm or greater than 1 μm can be regarded as having adhesion. In some embodiments, a number of particles having adhesion is determined to be a total number of particles observed in the microstructural imaging photographs subtracted by a number of particles having little or no adhesion. The specific values of the upper and lower limits of the range should not be limited by the embodiments of the present disclosure. In the present disclosure, a particle adhesion rate can be defined as a number of particles having adhesion divided by the total number of particle observed.

The micronized powder is mixed with antioxidant of no more than 1% in total weight and then pressed into a die under an aligning field with strength no less than 1.4 T. The die is then sintered in a vacuum furnace under temperature region between 1000 degrees Celsius and 1100 degrees Celsius. The sintered powder undergoes tempering treatment twice respectively under temperature ranges of between about 860 degrees Celsius to about 930 degrees Celsius and between about 450 degrees Celsius to about 550 degrees Celsius before the formation of raw magnet is completed.

Example 1

Neodymium alloy is processed in a strip caster to form thin strip of average thickness of about 0.32 mm, wherein its composition is $Nd_{31}D_{y1}Co_1Cu_{0.1}Zr_{0.08}Ga_{0.12}Al_{0.1}Nb_{0.3}Fe_{ba1}B_{0.97}$ (wt. %). The strip is then crushed into coarse powder through HD method and mixed with lubricator of about 0.05% in weight percentage by powder blender. The mixture undergoes target type jet mill pulverization afterwards, wherein pulverizing pressure is about 0.6 MPa. Jet steam nozzle and target are silicon nitride de Laval nozzle, where m is equal to 3 in the function involving the diameter of the target, diameter of the side nozzle and the distance between the target and the nozzle. Velocity of the jet stream is about 400 m/s from the nozzle. In the meantime, a ceramic classifier is selected wherein p=4 in the equation involving the diameter of the classifier and of the target. The produced pulverized powder consists of desired micronized powder which takes about 99.5% in total mass and ultrafine powder which takes about 0.5% in total mass with no residual material in the grinding chamber. The micronized powder is mixed with antioxidant of about 0.1 wt % by powder blender and pressed into a die under an aligning field with strength greater than 1.4 T. The die is sintered in a vacuum furnace at 1050 degrees Celsius for about 4 hours, and two tempering treatments for about 2 hours at about 930 degrees Celsius and for 3 hours at about 480 degree Celsius respectively to form Neodymium magnets.

Comparative Example 1

The process described above in example 1 is repeated, wherein identical Neodymium alloy strip is prepared and processed through HD to form coarse powder. The coarse powder then undergoes fluidized bed jet mil pulverization instead of target type jet mill pulverization in example 1 to form Neodymium magnets. The following pressing and sintering processes share the same parameter settings as those in example 1. TABLE 1 shows preparation methods, powder specifications and magnetic performances of Neodymium magnetics formed in example 1 and comparative example 1. In TABLES 1-5 of the present disclosure, for ease of illustration, examples 1, 2, 3, 4, and 5 are represented by "Exmp." 1, 2, 3, 4, and 5; nitrogen concentration is represented by "$N_2$ Conc."; and comparative example 1, 2, 3, 4, and 5 are represented by "Comp. Exmp." 1, 2, 3, 4, and 5.

TABLE 1

COMPARISON OF PREPARATION METHODS, POWDER SPECIFICATIONS AND MAGNETIC PERFORMANCES BETWEEN EXAMPLE 1 AND COMPARATIVE EXAMPLE 1

| Method | Yield rate | $N_2$ Conc. (ppm) | $D_{50}$ (um) | $D_{90}/D_{10}$ | $B_r$ (kGs) | $H_cJ$ (kOe) | $H_k/H_{cj}$ | $(BH)_{max}$ (MGsOe) |
|---|---|---|---|---|---|---|---|---|
| Exmp. 1 | 99.5% | 120 | 3.35 | 3.98 | 13.22 | 21.54 | 0.99 | 42.26 |
| Comp. Exmp. 1 | 97.5% | 575 | 4.56 | 5.42 | 13.21 | 18.26 | 0.93 | 41.88 |

According to TABLE 1, the yield rate of Neodymium magnetic material manufacturing in example 1 is greater than that of comparative example 1. The micronized powder prepared in example 1 has lower nitrogen concentration, lower dispersion in particle size distribution and better performances in coercivity and squareness in sintered magnets. Therefore, target type jet mill pulverization method in example 1 not only increases yield rate in micronized powder production but produces magnets of better coercivity and squareness with such micronized powder as raw material.

Meanwhile, a comparison was made between particles produced by target type jet mill pulverization and fluidized bed jet mill pulverization. FIG. 1 through FIG. 8 are microstructural imaging photographs of the micronized powder samples from example 1 and comparative example 1 at different magnifications, wherein statistical analysis was performed for 500 particles in each sample. The results show, in example 1, particles with little or no adhesion takes about 92.5% of the total number of particles, wherein the sphericity is approximately 98.5%; whereas in comparative example 1, particles with little or no adhesion takes about 70.9% of total number of particles, wherein the sphericity is approximately 92.5%.

Example 2

Neodymium alloy is processed in a strip caster to form thin strip of average thickness of 0.1 mm, wherein its composition is $(PrNd)_{30.8}Co_{0.5}Cu_{0.06}Zr_{0.10}Ga_{0.10}Al_{0.3}Nb_{0.3}Fe_{ba1}B_{0.94}$(wt. %). The strip is then crushed into coarse powder through HD method and mixed with lubricator of about 0.5% in weight percentage by powder blender. The mixture undergoes target type jet mill pulverization afterwards, wherein pulverizing pressure is about 0.3 MPa; jet steam nozzle and target are silicon nitride de Laval nozzle; m equals 2 in the function involving the diameter of the target, diameter of the side nozzle and the distance between the target and the nozzle; velocity of the jet stream is about 520 m/s from the nozzle. In the meantime, a ceramic classifier is selected wherein p=3.5 in the equation involving the diameter of the classifier and of the target. The produced pulverized powder consists of desired micronized powder which takes about 99.7% in total mass and ultrafine powder which takes about 0.3% in total mass with no residual material in the grinding chamber. The micronized powder is mixed with antioxidant of about 0.3 wt % by powder blender and pressed into a die under an aligning field with strength greater than 1.4 T. The die is sintered in a vacuum furnace at 1040 degrees Celsius for about 4 hours, and two tempering treatment for about 2 hours at about 890 degrees Celsius and for about 3 hours at about 490 degrees Celsius respectively to form Neodymium magnets.

Comparative Example 2

The process described above in example 2 is repeated, wherein identical Neodymium alloy strip is prepared and processed through HD to form coarse powder. The coarse powder then undergoes fluidized bed jet mil pulverization instead of target type jet mill pulverization in example 2 to form Neodymium magnets. The following pressing and sintering processes share the same parameter settings as those in example 2. TABLE 2 shows preparation methods, powder specifications and magnetic performances of Neodymium magnetics formed in example 2 and comparative example 2.

TABLE 2

COMPARISON OF PREPARATION METHODS, POWDER SPECIFICATIONS AND MAGNETIC PERFORMANCES BETWEEN EXAMPLE 2 AND COMPARATIVE EXAMPLE 2

| Method | Yield Rate | $N_2$ Conc. (ppm) | $D_{50}$ (um) | $D_{90}/D_{10}$ | $B_r$ (kGs) | $H_{cJ}$ (kOe) | $H_k/H_{cj}$ | $(BH)_{max}$ (MGsOe) |
|---|---|---|---|---|---|---|---|---|
| Exmp. 2 | 99.7% | 175 | 3.56 | 3.42 | 13.85 | 16.94 | 0.97 | 46.63 |
| Comp. Exmp. 2 | 97.8% | 620 | 4.35 | 5.98 | 13.79 | 15.92 | 0.92 | 46.21 |

According to TABLE 2, the yield rate of Neodymium magnetic material manufacturing in example 2 is greater than that of comparative example 2. The micronized powder prepared in example 2 has lower nitrogen concentration, lower dispersion in particle size distribution and better performances in coercivity and squareness in sintered magnets. Therefore, target type jet mill pulverization method in example 2 not only increases yield rate in micronized powder production but produces magnets of better coercivity and squareness with such micronized powder as raw material.

Meanwhile, a comparison was made between particles produced by target type jet mill pulverization and fluidized bed jet mill pulverization. Statistical analysis was performed for 500 particles in each sample. The results show, in example 2, particles with no adhesion takes about 91.6% of total number of particles, wherein the sphericity is approximately 96.0%; whereas in comparative example 2, particles with no adhesion takes about 73.4% of total number of particles, wherein the sphericity is approximately 82.5%.

Example 3

Neodymium alloy is processed in a strip caster to form thin strip of average thickness of 0.4 mm, wherein its composition is $(PrNd)_{26}Dy_5Co_{1.3}Cu_{0.15}Zr_{0.08}Ga_{0.16}Al_{0.25}Fe_{ba1}B_{0.97}$ (wt. %). The strip is then crushed into coarse powder through HD method and mixed with lubricator of about 0.3% in weight percentage by powder blender. The mixture undergoes target type jet mill pulverization afterwards, wherein pulverizing pressure is about 0.8 MPa. Jet steam nozzle and target are silicon nitride de Laval nozzle, where m equals 5 in the function involving the diameter of the target, diameter of the side nozzle and the distance between the target and the nozzle. Velocity of the jet stream is about 320 m/s from the nozzle. In the meantime, a ceramic classifier is selected wherein p=4.5 in the equation involving the diameter of the classifier and of the target. The produced pulverized powder consists of desired micronized powder which takes about 99.6% in total mass and ultrafine powder which takes about 0.4% in total mass with no residual material in the grinding chamber. The micronized powder is mixed with antioxidant of about 0.3 wt % by powder blender and pressed into a die under an aligning field with strength greater than 1.4 T. The die is sintered in a vacuum furnace at about 1065 degrees Celsius for about 4 hours, and two tempering treatment for about 2 hours at about 920 degrees Celsius and for about 6 hours at about 480 degree Celsius respectively to form Neodymium magnets.

Comparative Example 3

The process described above in example 3 is repeated, wherein identical Neodymium alloy strip is prepared and processed through HD to form coarse powder. The coarse powder then undergoes fluidized bed jet mil pulverization instead of target type jet mill pulverization in example 3 to form Neodymium magnets. The following pressing and sintering processes share the same parameter settings as those in example 3. TABLE 3 shows preparation methods, powder specifications and magnetic performances of Neodymium magnetics formed in example 3 and comparative example 3.

TABLE 3

COMPARISON OF PREPARATION METHODS, POWDER SPECIFICATIONS AND MAGNETIC PERFORMANCES BETWEEN EXAMPLE 3 AND COMPARATIVE EXAMPLE 3

| Method | Yield Rate | $N_2$ Conc. (ppm) | $D_{50}$ (um) | $D_{90}/D_{10}$ | $B_r$ (kGs) | $H_{cJ}$ (kOe) | $H_k/H_{cj}$ | $(BH)_{max}$ (MGsOe) |
|---|---|---|---|---|---|---|---|---|
| Exmp. 3 | 99.6% | 205 | 2.96 | 3.15 | 12.45 | 28.97 | 0.95 | 36.45 |
| Comp. Exmp. 3 | 98.1% | 592 | 4.28 | 5.43 | 12.39 | 26.82 | 0.89 | 36.32 |

According to table 3, the yield rate of Neodymium magnetic material manufacturing in example 3 is greater than that of comparative example 3. The micronized powder prepared in example 3 has lower nitrogen concentration, lower dispersion in particle size distribution and better performances in coercivity and squareness in sintered magnets. Therefore, target type jet mill pulverization method in example 3 not only increases yield rate in micronized powder production but produces magnets of better coercivity and squareness with such micronized powder as raw material.

Meanwhile, a comparison was made between particles produced by target type jet mill pulverization and fluidized bed jet mill pulverization. Statistical analysis was performed for 500 particles in each sample. The results show, in example 3, particles with little or no adhesion takes about 93.5% of total number of particles, wherein the sphericity is approximately 97.2%; whereas in comparative example 3, particles with little or no adhesion takes about 76.8% of total number of particles, wherein the sphericity is approximately 87.4%.

Example 4

Neodymium alloy is processed in a strip caster to form thin strip of average thickness of about 0.15 mm, wherein its composition is $Nd_{31}Dy_1Co_1Cu_{0.1}Zr_{0.08}Ga_{0.12}Al_{0.1}Nb_{0.3}Fe_{ba1}B_{0.97}$ (wt. %). The strip is then crushed into coarse powder through HD method and mixed with lubricator of about 0.05% in weight percentage by powder blender. The mixture undergoes target type jet mill pulverization afterwards, wherein pulverizing pressure is about 0.4 MPa. Jet steam nozzle and target are silicon nitride de Laval nozzle, where m equals 1 in the function involving the diameter of the target, diameter of the side nozzle and the distance between the target and the nozzle. Velocity of the jet stream is about 580 m/s from the nozzle. In the meantime, a ceramic classifier is selected wherein p=3 in the equation involving the diameter of the classifier and of the target. The produced pulverized powder consists of desired micronized powder which takes about 99.5% in total mass and ultrafine powder which takes about 0.5% in total mass with no residual material in the grinding chamber. The micronized powder is mixed with antioxidant of about 0.3 wt % by powder blender and pressed into a die under an aligning field with strength greater than 1.4 T. The die is sintered in a vacuum furnace at about 1050 degree Celsius for about 4 hours, and two tempering treatment for about 2 hours at about 920 degree Celsius and for about 3 hours at about 480 degree Celsius respectively to form Neodymium magnets.

Comparative Example 4

The process described above in example 4 is repeated, wherein identical Neodymium alloy strip is prepared and processed through HD to form coarse powder. The coarse powder then undergoes fluidized bed jet mil pulverization instead of target type jet mill pulverization in example 4 to form Neodymium magnets. The following pressing and sintering processes share the same parameter settings as those in example 4. TABLE 4 shows preparation methods, powder specifications and magnetic performances of Neodymium magnetics formed in example 4 and comparative example 4.

According to TABLE 4, the yield rate of Neodymium magnetic material manufacturing in example 4 is greater than that of comparative example 4. The micronized powder prepared in example 4 has lower nitrogen concentration, lower dispersion in particle size distribution and better performances in coercivity and squareness in sintered magnets. Therefore, target type jet mill pulverization method in example 4 not only increases yield rate in micronized powder production but produces magnets of better coercivity and squareness with such micronized powder as raw material.

Meanwhile, a comparison was made between particles produced by target type jet mill pulverization and fluidized bed jet mill pulverization. Statistical analysis was performed for 500 particles in each sample. The results show, in example 4, particles with little or no adhesion takes about 90.8% of total number of particles, wherein the sphericity is approximately 96.2%; whereas in comparative example 4, particles with little or no adhesion takes about 70.9% of total number of particles, wherein the sphericity is approximately 80.3%.

Example 5

Neodymium alloy is processed in a strip caster to form thin strip of average thickness of 0.20 mm, wherein its composition is $Nd_{31}Dy_1Co_{0.1}Cu_{0.08}Zr_{0.08}Ga_{0.12}Al_{0.1}Nb_{0.3}Fe_{ba1}B_{0.97}$ (wt. %). The strip is then crushed into coarse powder through HD method and mixed with lubricator of about 0.05% in weight percentage by powder blender. The mixture undergoes target type jet mill pulverization afterwards, wherein pulverizing pressure is about 0.7 MPa. Jet steam nozzle and target are silicon nitride de Laval nozzle, where m equals 1 in the function involving the diameter of the target, diameter of the side nozzle and the distance between the target and the nozzle. Velocity of the jet stream is about 450 m/s from the nozzle. In the meantime, a ceramic classifier is selected wherein p=6 in the equation involving the diameter of the classifier and of the target. The produced pulverized powder consists of desired micronized powder which takes about 99.5% in total mass and ultrafine powder which takes about 0.5% in total mass with no residual material in the grinding chamber. The micronized powder is mixed with antioxidant of about 0.3 wt % by powder blender and pressed into a die under an aligning field with strength greater than about 1.4 T. The die is sintered in a vacuum furnace at 1050 degrees Celsius for about 4 hours, and two tempering treatment for about 2 hours at about 920 degree Celsius and for about 3 hours at about 480 degree Celsius respectively to form Neodymium magnets.

TABLE 4

COMPARISON OF PREPARATION METHODS, POWDER SPECIFICATIONS AND MAGNETIC PERFORMANCES BETWEEN EXAMPLE 4 AND COMPARATIVE EXAMPLE 4

| Method | Yield Rate | $N_2$ Conc. (ppm) | $D_{50}$ (um) | $D_{90}/D_{10}$ | $B_r$ (kGs) | $H_{cJ}$ (kOe) | $H_k/H_{cj}$ | $(BH)_{max}$ (MGsOe) |
|---|---|---|---|---|---|---|---|---|
| Exmp. 4 | 99.5% | 203 | 3.82 | 4.17 | 13.22 | 20.26 | 0.96 | 42.26 |
| Comp. Exmp. 4 | 97.5% | 575 | 4.56 | 5.42 | 13.21 | 18.26 | 0.93 | 41.88 |

Comparative Example 5

The process described above in example 5 is repeated, wherein identical Neodymium alloy strip is prepared and processed through HD to form coarse powder. The coarse powder then undergoes fluidized bed jet mil pulverization instead of target type jet mill pulverization in example 5 to form Neodymium magnets. The following pressing and sintering processes share the same parameter settings as those in example 5. TABLE 5 shows preparation methods, powder specifications and magnetic performances of Neodymium magnetics formed in example 5 and comparative example 5.

TABLE 5

COMPARISON OF PREPARATION METHODS, POWDER SPECIFICATIONS AND MAGNETIC PERFORMANCES BETWEEN EXAMPLE 5 AND COMPARATIVE EXAMPLE 5

| Method | Yield Rate | $N_2$ Conc. (ppm) | $D_{50}$ (um) | $D_{90}/D_{10}$ | $B_r$ (kGs) | $H_{cJ}$ (kOe) | $H_k/H_{cj}$ | $(BH)_{max}$ (MGsOe) |
|---|---|---|---|---|---|---|---|---|
| Exmp. 5 | 99.5% | 179 | 3.67 | 3.92 | 13.22 | 20.76 | 0.97 | 42.26 |
| Comp. Exmp. 5 | 97.5% | 575 | 4.56 | 5.42 | 13.21 | 18.26 | 0.93 | 41.88 |

According to TABLE 5, the yield rate of Neodymium magnetic material manufacturing in example 5 is greater than that of comparative example 5. The micronized powder prepared in example 5 has lower nitrogen concentration, lower dispersion in particle size distribution and better performances in coercivity and squareness in sintered magnets. Therefore, target type jet mill pulverization method in example 5 not only increases yield rate in micronized powder production but produces magnets of better coercivity and squareness with such micronized powder as raw material.

Meanwhile, a comparison was made between particles produced by target type jet mill pulverization and fluidized bed jet mill pulverization. Statistical analysis was performed for 500 particles in each sample. The results show, in example 5, particles with little or no adhesion takes about 91.6% of total number of particles, wherein the sphericity is approximately 94.3%; whereas in comparative example 5, particles with little or no adhesion takes about 70.9% of total number of particles, wherein the sphericity is approximately 80.3%.

According to the examples of implementing target type jet mill pulverization and comparative examples of implementing fluidized bed jet mill pulverization listed above, it can be concluded that the micronized sintered Neodymium magnetic material powder claimed in the current invention has greater sphericity and smaller particle adhesion rate. The micronized powder has lower nitrogen concentration, even particle-size distribution with low dispersion. The claimed method produces little or no material residual. The sintered Neodymium magnetic material produced by the claimed micronized powder exhibits better coercivity and squareness.

It should be noted that the embodiments listed above are merely illustrative examples of the current invention not limitation of its application. The current invention could be changed or modified in other forms for technician in the field. There is no need and no possibility to list the embodiment exhaustively. Therefore, obvious changes and modification based upon the current invention are still under the protection of the current invention.

What is claimed is:

1. A pulverization method for preparing micronized powder, wherein:

a relationship amongst a diameter A of a target, a diameter B of a side nozzle, and a distance C between a center of the target and the side nozzle is $A/B=m\times(C/(A+B))$, m ranging from 1 to 7, a velocity of a jet stream from the side nozzle being about 320 m/s to about 580 m/s; and a relationship between a diameter of a classifier wheel F and the diameter of the target A is $F=p\times A$, p ranging from 3 to 6.

2. The pulverization method according to claim 1, further comprising:

collecting the micronized powder including:

flowing pulverized powder having the micronized powder and an ultrafine powder into a cyclone separator;

filtering out the ultrafine powder having diameters less than about 1 μm at an exit of the cyclone separator; and collecting the micronized powder at another exit of the cyclone separator after the ultrafine powder is filtered out;

wherein the cyclone separator comprises a baffle having a flange which comprises a plurality of holes with diameters of less than or equal to about 1 μm.

3. The pulverization method according to claim 1, wherein m is in a range of 2 to 5.

4. The pulverization method according to claim 1, wherein the velocity of the jet stream from the side nozzle is about 400 m/s to about 520 m/s.

5. The pulverization method claimed in claim 1, wherein p is in a range of 3.5 to 4.5.

6. The pulverization method according to claim 1, wherein the target, the side nozzle, and the classifier wheel are made of silicon nitride.

7. The pulverization method according to claim 1, wherein a pulverizing gas is nitrogen and a pulverizing pressure is in a range of about 0.3 MPa to about 0.8 MPa.

8. The pulverization method according to claim 7, wherein the pulverizing pressure is about 0.4 MPa to about 0.7 MPa.

9. The pulverization method according to claim 1, wherein no material residual is produced.

10. The pulverization method according to claim 2, wherein the ultrafine powder is less than about 0.5% of the pulverized powder in total mass.

11. The pulverization method according to claim 1, wherein the micronized powder is characterized by a sphericity of greater than 90% and a particle adhesion rate of less than 10%.

12. The pulverization method according to claim 1, wherein:

particle size $D_{50}$ of the micronized powder is about 2 μm to about 5 μm and $D_{90}/D_{10}$ of the micronized powder is equal to about 2 to about 5; and a nitrogen concentration of the micronized powder is equal or less than 300 ppm.

* * * * *